US006253646B1

(12) United States Patent
Chang

(10) Patent No.: US 6,253,646 B1
(45) Date of Patent: Jul. 3, 2001

(54) ROLLER-TYPE RATCHET DEVICE FOR WRENCH

(76) Inventor: Chuck (Chen-Tsai) Chang, No. 176-3, Guangming Rd., Taichung (TW)

( * ) Notice: Subject to any disclaimer, the term of this patent is extended or adjusted under 35 U.S.C. 154(b) by 0 days.

(21) Appl. No.: 09/522,437

(22) Filed: Mar. 9, 2000

(51) Int. Cl.[7] ..... B25B 13/00

(52) U.S. Cl. ..... 81/59.1; 81/60; 81/61; 192/44

(58) Field of Search ..... 81/59.1, 60, 61, 81/62, 63; 192/44, 45

(56) References Cited

U.S. PATENT DOCUMENTS 5,848,561 * 12/1998 Hsieh .
5,941,140 * 8/1999 Susksi .
6,112,624 * 9/2000 Chen .

* cited by examiner

*Primary Examiner*—Derris H. Banks
*Assistant Examiner*—Willie Berry, Jr.
(74) *Attorney, Agent, or Firm*—Rosenberg, Klein & Lee

(57) ABSTRACT

A roller-type ratchet device is used for a wrench which includes a driving head defining a receiving hole and a plurality of actuating recesses. The ratchet device includes a driving body secured in the receiving hole to rotate with the driving head, a follower secured between the driving body and the driving head and having a plurality of fixed portions each mounted in a respective one of the actuating recesses, a plurality of locking members each secured in a respective one of the fixed portions of the follower to move therewith, and each pressing the driving body, and a direction control knob pivotally mounted on the driving head and engaged with the follower for moving each of the locking members in the respective actuating recess between different positions.

16 Claims, 23 Drawing Sheets

ROLLER-TYPE RATCHET DEVICE FOR WRENCH

BACKGROUND OF THE INVENTION

1. Field of the Invention

The present invention relates to a roller-type ratchet device, and more particularly to a roller-type ratchet device for a wrench.

2. Description of the Related Art

A conventional ratchet wrench in accordance with the prior art shown in FIG. 27 comprises a driving head 50 defining a hole 51 for receiving a driving body 60 which is rotated by the driving head 50 so as to rotate a workpiece (not shown) such as a hexagonal nut, bolt or the like. The driving body 60 defines an actuating recess 61 for receiving an anti-reverse roller 70 and an elastic member 80.

However, the anti-reverse roller 70 and the elastic member 80 are separately and are not easily mounted in the actuating recess 61 so that it is difficult to assemble and dismantle the ratchet wrench. In addition, the anti-reverse roller 70 is not actually pressed between the driving head 50 and the driving body 60 so that the driving body 60 cannot be efficiently driven by the driving head 50.

SUMMARY OF THE INVENTION

In accordance with one aspect of the present invention, there is provided a roller-type ratchet device for a wrench which includes a driving head, a receiving hole defined through the driving head, and a plurality of actuating recesses each defined in a wall of the receiving hole.

The ratchet device comprises a driving body secured in the receiving hole to rotate with the driving head and defining a hexagonal driving hole therein; a follower secured in the receiving hole to rotate with the driving head and located between the driving body and the driving head, the follower including a plurality of fixed portions each movably mounted in a respective one of the actuating recesses; a plurality of locking members each secured in a respective one of the fixed portions of the follower to move therewith, and each pressing the driving body; and a direction control knob pivotally mounted on the driving head and engaged with the follower for moving each of the locking members in the respective actuating recess between two different positions.

In accordance with another aspect of the present invention, there is provided a roller-type ratchet device for a wrench which includes a driving head having a receiving hole defined therethrough.

The ratchet device comprises a driving body secured in the receiving hole to rotate with the driving head and including an inner wall having a hexagonal driving hole therethrough, and an outer wall defining a plurality of anti-reverse recesses, each of the anti-reverse recesses including a first portion and a second portion having a depth smaller than that of the first portion; a follower secured in the receiving hole to rotate with the driving head and located between the driving body and the driving head, the follower including a plurality of fixed portions each mounted in a respective one of the anti-reverse recesses; and a plurality of anti-reverse rollers each secured in a respective one of the fixed portions of the follower to move therewith, and each pressing the first portion of the respective anti-reverse recess of the driving body.

Further benefits and advantages of the present invention will become apparent after a careful reading of the detailed description with appropriate reference to the accompanying drawings.

DETAILED DESCRIPTION OF THE INVENTION

Figure 1:
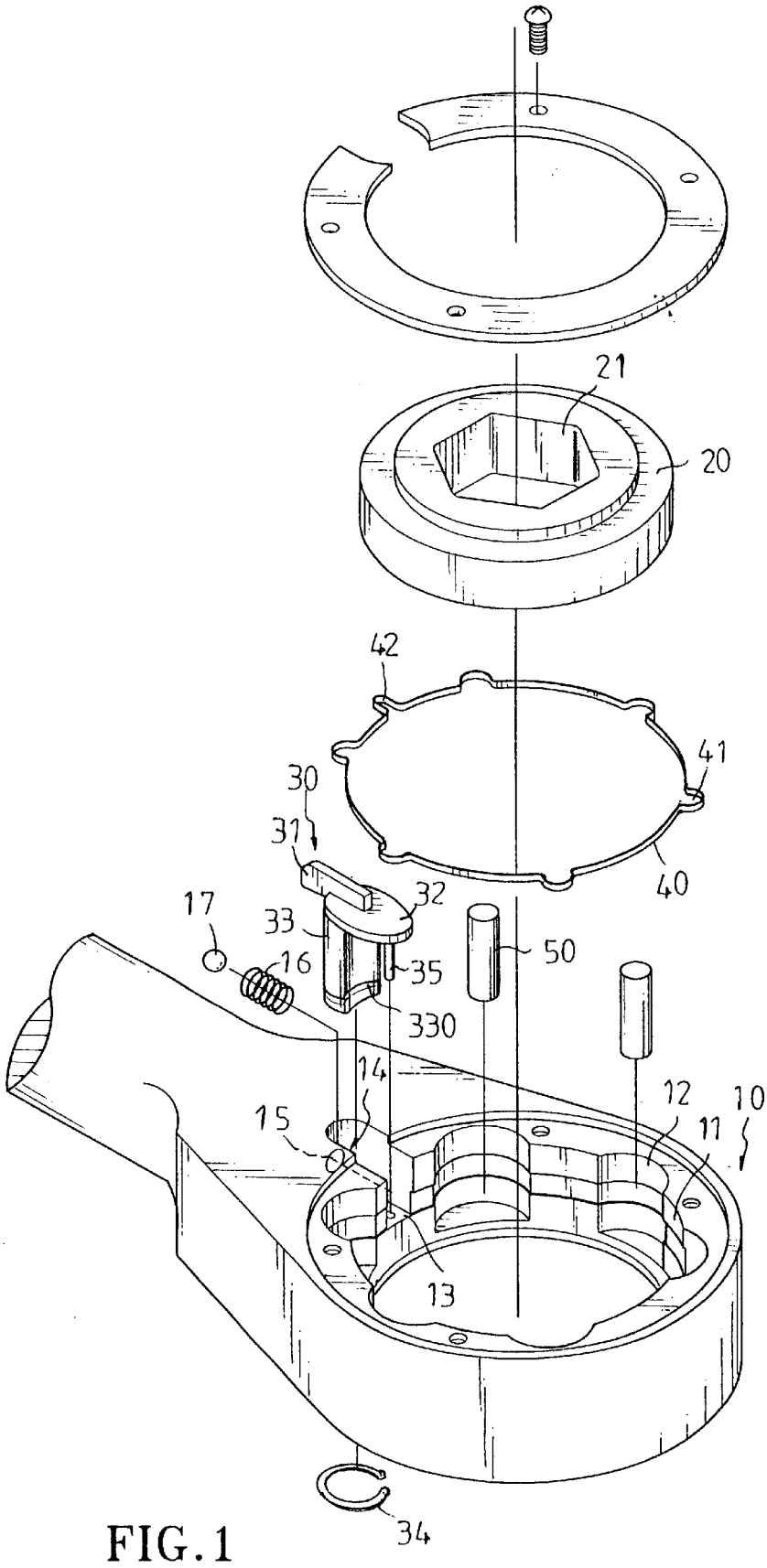
FIG. 1 is an exploded view of a roller-type ratchet device for a wrench in accordance with the present invention.

Referring to the drawings and initially to FIGS. 1–5, a roller-type ratchet device in accordance with the present invention is used for a wrench which includes a driving head 10, a receiving hole 11 defined through the driving head 10, and a plurality of arcuate actuating recesses 12 each defined in the wall of the receiving hole 11.

The ratchet device comprises a driving body 20 secured in the receiving hole 11 to rotate with the driving head 10 and defining a hexagonal driving hole 21 therein, a follower 40 made of a ring-shaped flexible piece secured between the driving body 20 and the driving head 10 to rotate with the driving head 10 and including a plurality of C-shaped fixed portions 41 each extending radially outward and each movably mounted in a respective one of the actuating recesses 12, a plurality of rod-shaped locking members 50 each secured in a respective one of the C-shaped fixed portions 41 of the follower 40 to move therewith, and each pressing the driving body 20, and a direction control knob 30 pivotally mounted on the driving head 10 and engaged with the follower 40 for moving each of the locking members 50 in the respective actuating recess 12 between two different positions.

The driving head 10 has an inner wall defining a receiving chamber 13 connecting to the receiving hole 11, and a pivot hole 14 defined through the driving head 10 and connecting to the receiving chamber 13. The follower 40 further includes a protruding driven portion 42 movably received in the receiving chamber 13. The direction control knob 30 includes a pivot base 33 pivotally mounted in the pivot hole 14 and having a lower portion defining a peripheral retaining groove 330, a C-shaped snapping member 34 mounted in the retaining groove 330 and abutting the bottom of the driving head 10, a supporting base 32 secured on the pivot base 33 to pivot therewith and abutting the driving head 10, a control portion 31 secured to the supporting base 32 for pivoting the pivot base 32 about the pivot base 33, and a driving rod 35 secured to the supporting base 32 to pivot therewith and engaged with the driven portion 42 of the follower 40 for moving the driven portion 42 of the follower 40.

The driving head 10 further defines a transverse receiving space 15 connecting to the pivot hole 14. The direction control knob 30 further includes a pawl member 331 formed on the pivot base 33 and located opposite to the driving rod 35. The ratchet device further comprises a ball 17 received in the receiving space 15 and detachably pressing the pawl member 331, and a biasing member 16 received in the receiving space 15 and urged between the ball 17 and the wall of the receiving space 15.

Figure 2:
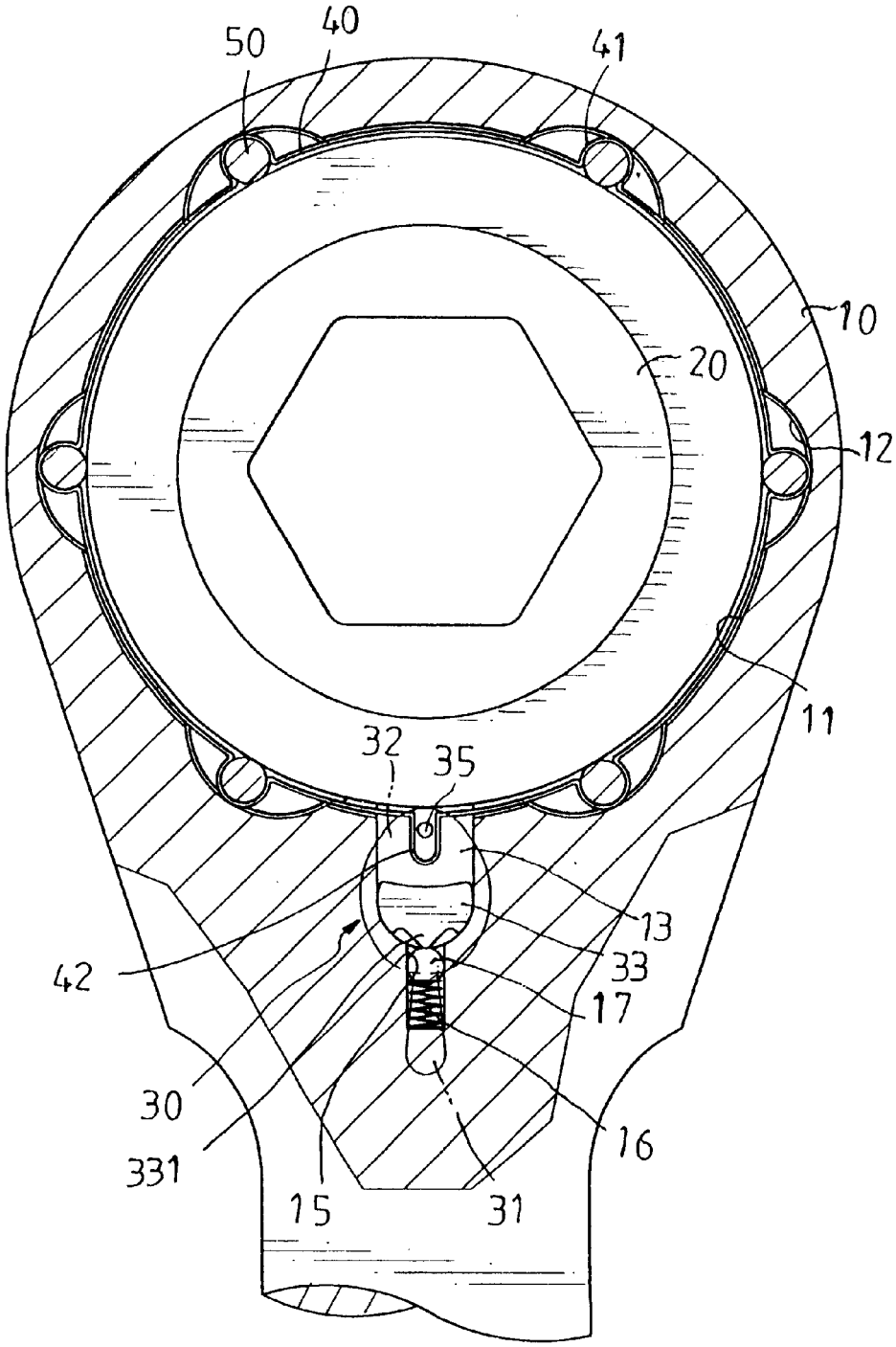
FIG. 2 is a top plan cross-sectional assembly view of the ratchet device as shown in FIG. 1.
Figure 3:
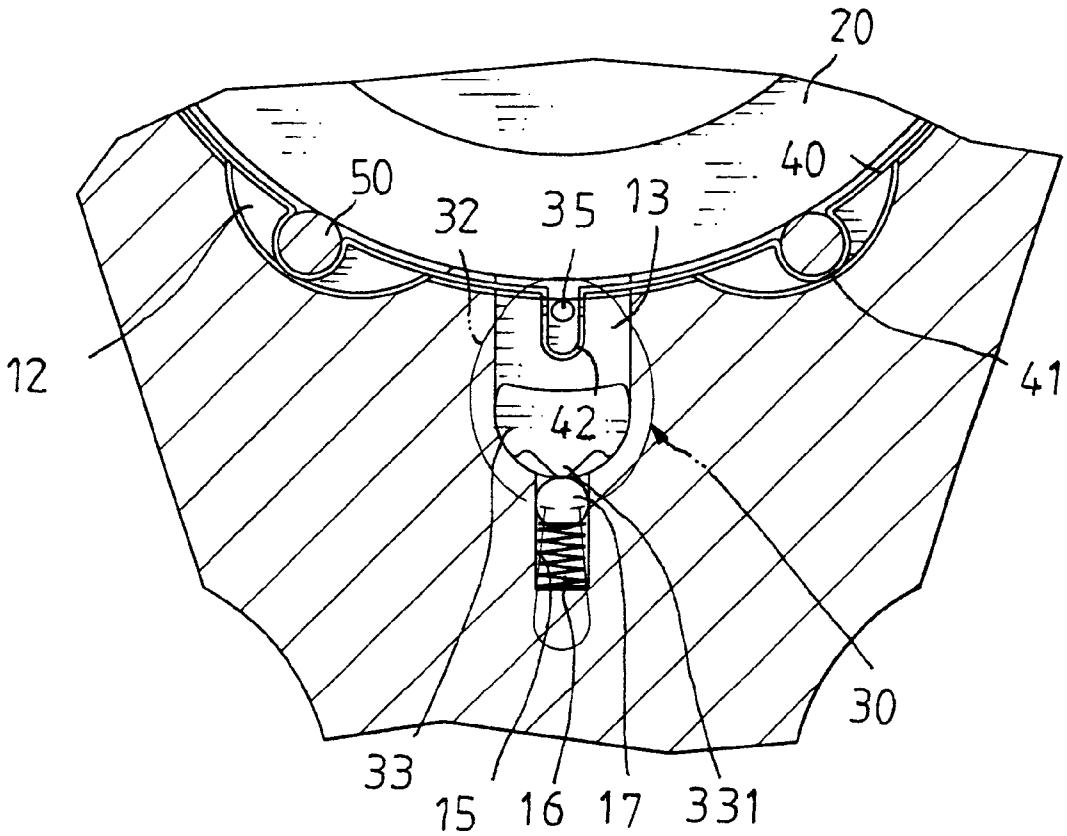
FIG. 3 is a partially enlarged view of the ratchet device as shown in FIG. 2.
Figure 5:
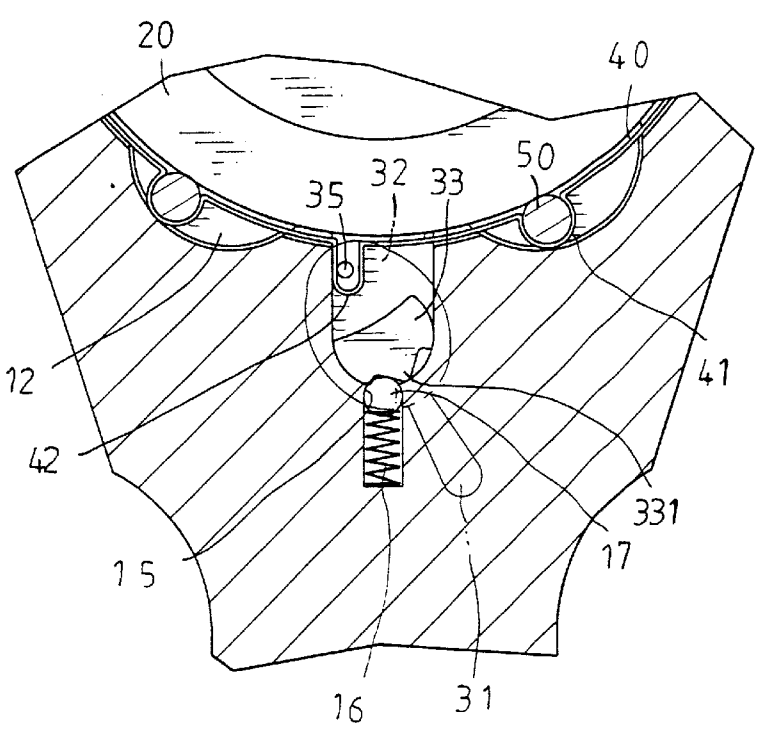
FIG. 5 is an operational view of the ratchet device as shown in FIG. 3.
Figure 4:
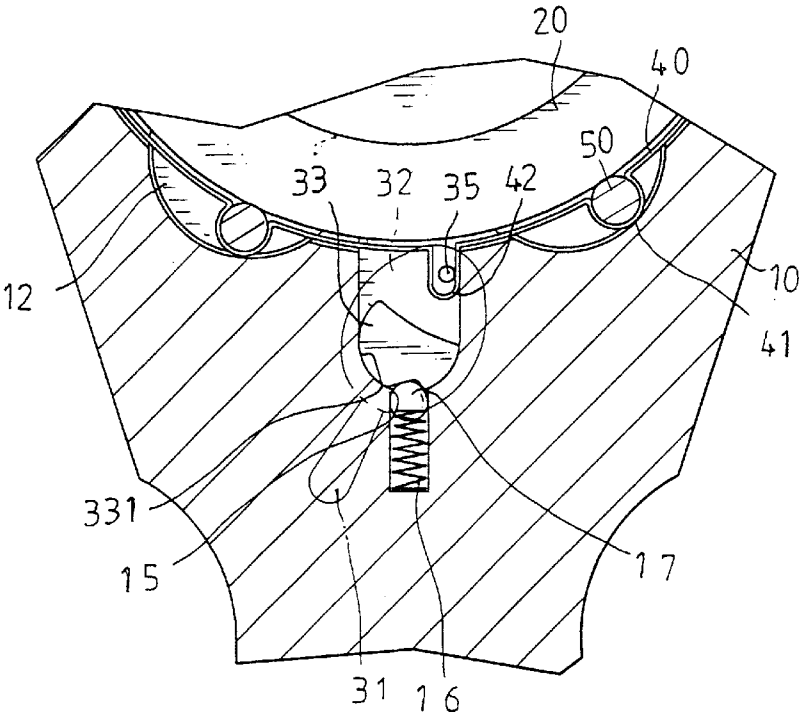
FIG. 4 is an operational view of the ratchet device as shown in FIG. 3.

In operation, referring to FIGS. 3–5 with reference to FIGS. 1 and 2, the supporting base 32 together with the pivot base 33 is rotated by moving the control portion 31 of the direction control knob 30 so as to move the driving rod 35 which then moves the driven portion 42 of the follower 40 so that each of the fixed portions 41 of the follower 40 together with the respective locking member 50 can be moved from the position as shown in FIG. 3 to the position as shown in FIG. 4.

By such an arrangement, the driving body 20 is fitted on a workpiece (not shown) such as a hexagonal nut, bolt or the like, with the workpiece being received in the hexagonal driving hole 21. When the driving head 10 is rotated in a clockwise direction, the driving body 20 is pressed by each of the locking members 50 to rotate with the driving head 10 for rotating the workpiece. When the driving head 10 is rotated counterclockwise, the driving body 20 is disengaged from the locking members 50, and will not be rotated with the driving head 10 so that the driving head 10 idles. In such a manner, the wrench can function as a ratchet wrench.

Alternatively, the supporting base 32 together with the pivot base 33 is rotated by moving the control portion 31 of the direction control knob 30 so as to move the driving rod 35 which then moves the driven portion 42 of the follower 40 so that each of the fixed portions 41 of the follower 40 together with the respective locking member 50 can be moved from the position as shown in FIG. 3 to the position as shown in FIG. 5.

By such an arrangement, when the driving head 10 is rotated in a counterclockwise direction, the driving body 20 is pressed by the locking members 50 to rotate with the driving head 10 for rotating the workpiece. When the driving head 10 is rotated in a clockwise direction, the driving body 20 is disengaged from the locking members 50, and will not be rotated with the driving head 10 so that the driving head 10 idles. In such a manner, the wrench can function as a ratchet wrench.

In such a manner, the wrench according to the present invention can function as a bi-directional ratchet wrench.

Accordingly, the follower 40 together with the locking members 50 can be previously coupled together with each other to be fitted in the receiving hole 11 of the driving head 10, and the direction control knob 30 is then fitted in the pivot hole 14 so that the ratchet device can be easily assembled and dismantled, thereby decreasing the cost of fabrication and production. In addition, the follower 40 is fully fitted in the receiving hole 11 of the driving head 10 without increasing the thickness of the driving head 10 of the wrench. Moreover, the driving body 20 is driven by a plurality of locking members 50, thereby providing a large torque and a multiple anti-slid effect on the workpiece. Further, the follower 40 and the direction control knob 30 are made with flexibility and elasticity so that the locking members 50 can be actually positioned.

Figure 6:
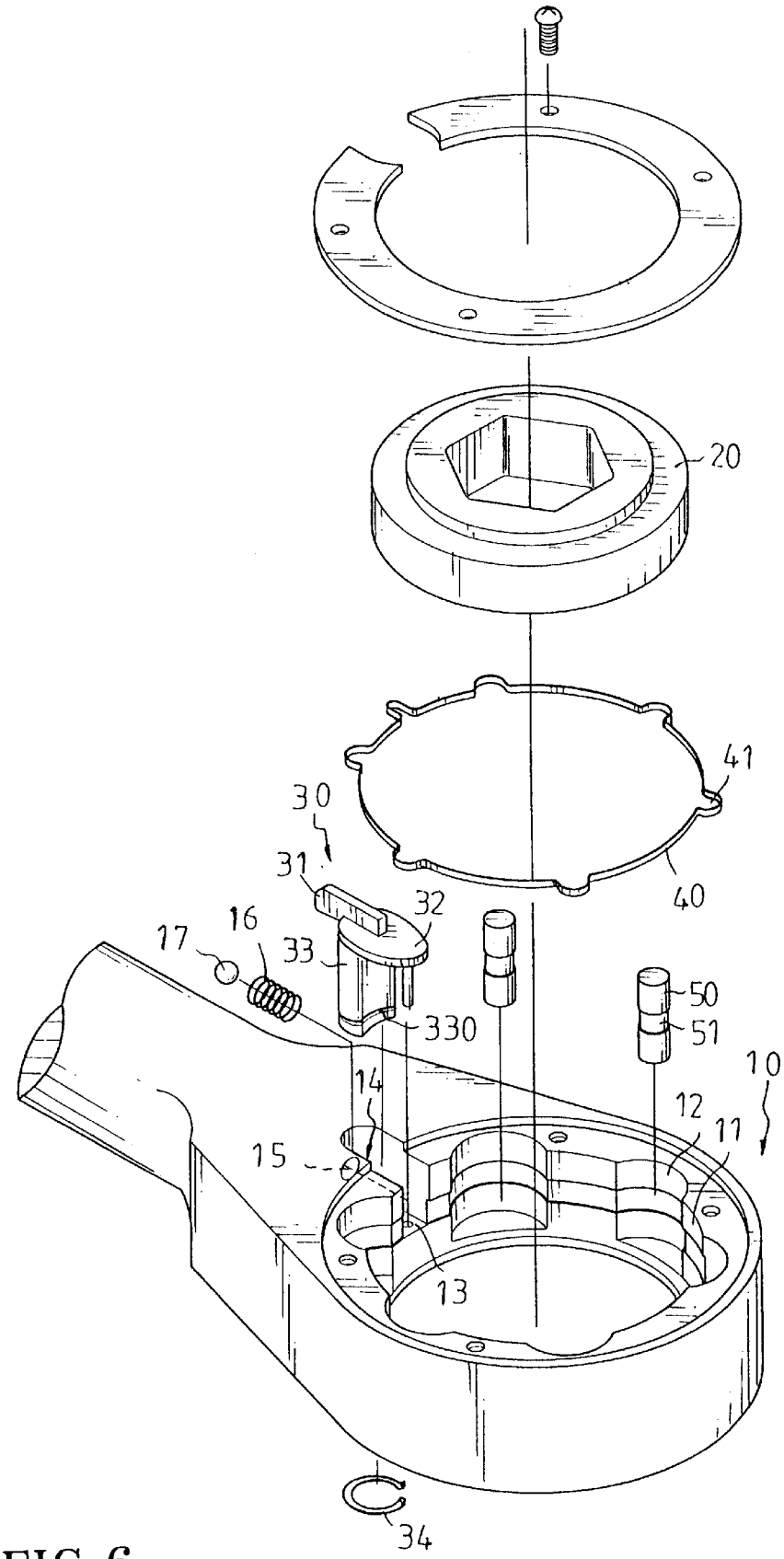
FIG. 6 is an exploded view of a roller-type ratchet device for a wrench in accordance with another embodiment of the present invention.

Referring to FIG. 6, in accordance with another embodiment of the present invention, each of the rod-shaped locking members 50 defines an annular retaining depression 51 for securing a respective one of the C-shaped fixed portions 41 of the follower 40 therein.

Figure 7:
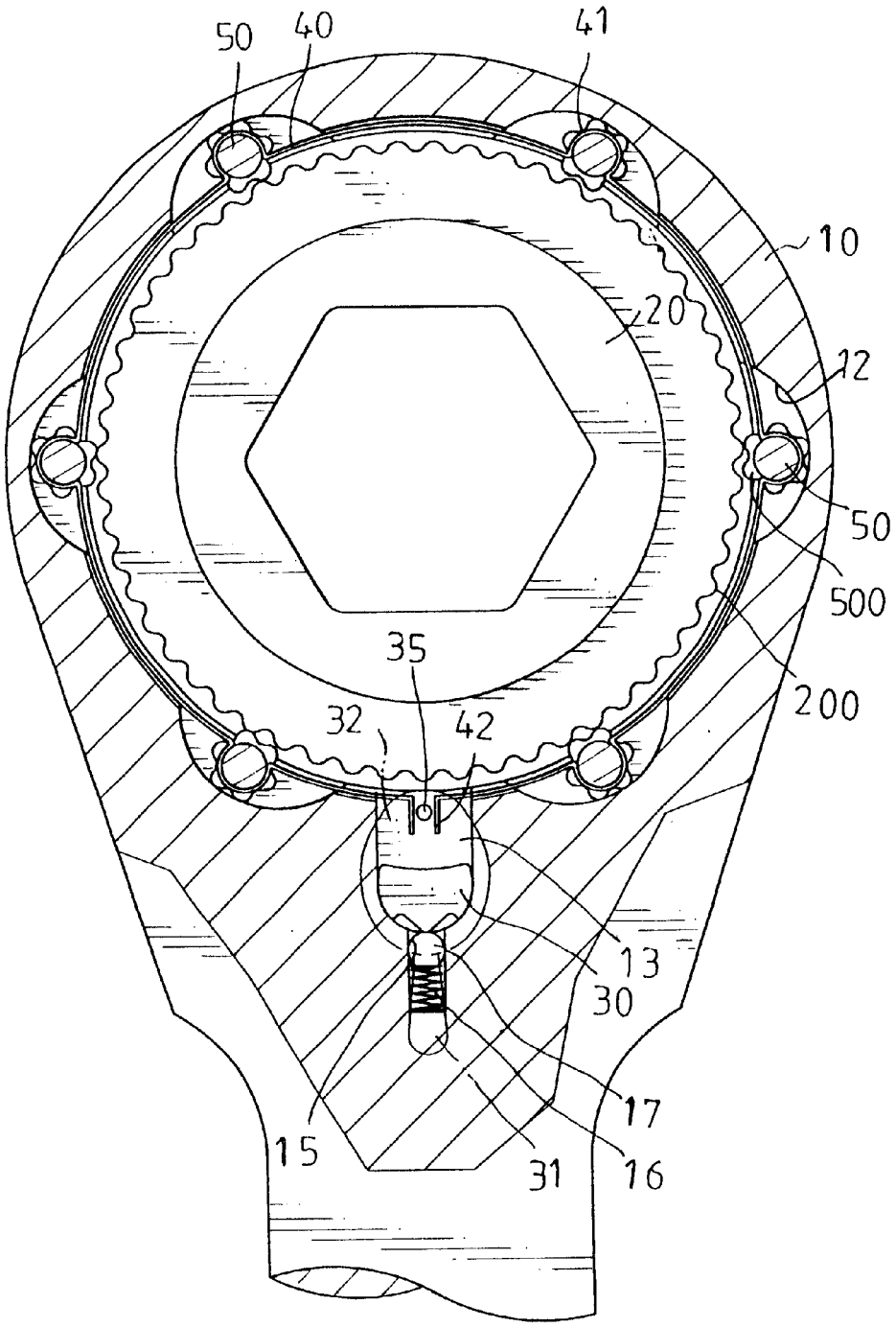
FIG. 7 is a top plan cross-sectional assembly view of a roller-type ratchet device for a wrench in accordance with a further embodiment of the present invention.
Figure 8:
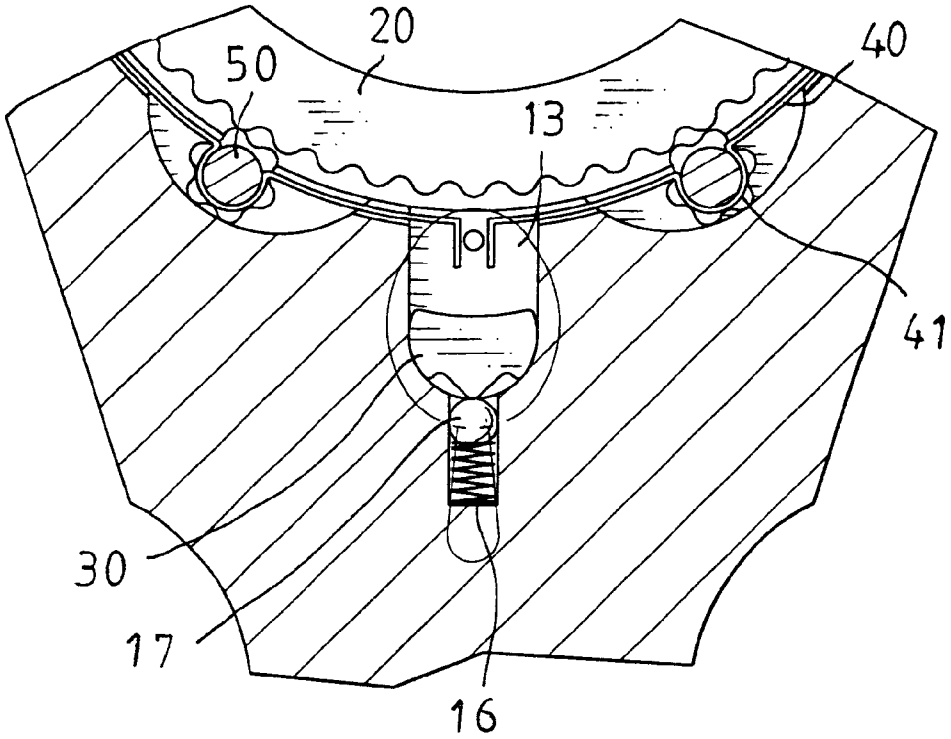
FIG. 8 is a partially enlarged view of the ratchet device as shown in FIG. 7.

Referring to FIGS. 7 and 8, in accordance with a further embodiment of the present invention, the driving body 20 includes a plurality of arcuate first teeth 200 formed on an outer periphery thereof, and each of the locking members 50 includes a plurality of arcuate second teeth 500 formed on an outer periphery thereof and engaged with the first teeth 200 of the driving body 20. In addition, the driven portion 42 of the follower 40 is made with a fork shape.

Figure 9:
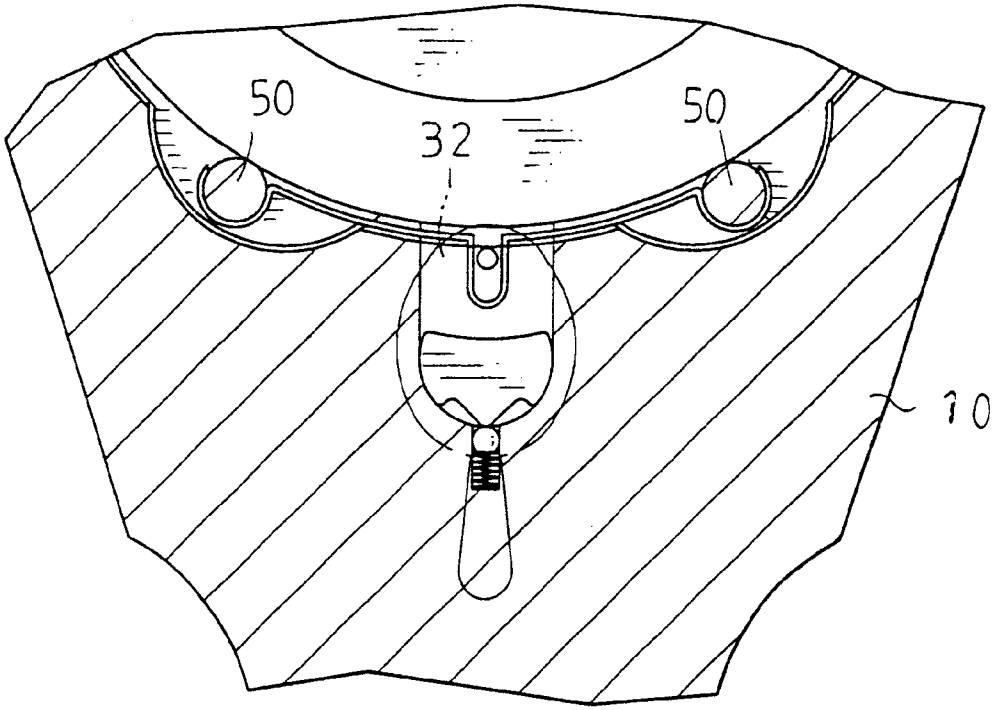
FIG. 9 is a top plan cross-sectional assembly view of a roller-type ratchet device for a wrench in accordance with a further embodiment of the present invention.

Referring to FIG. 9, in accordance with a further embodiment of the present invention, two sets of locking members 50 are provided.

Figure 10:
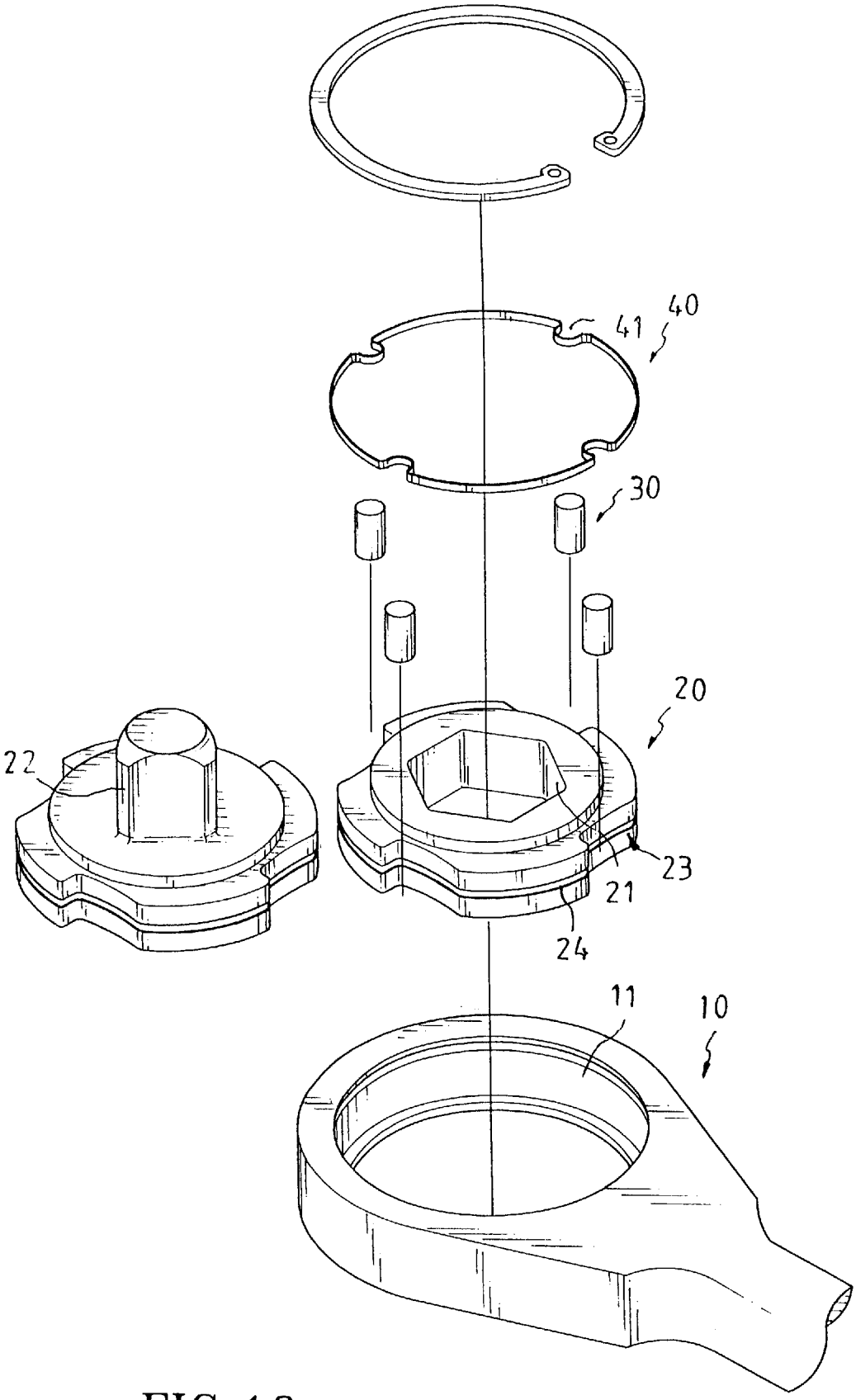
FIG. 10 is an exploded view of a roller-type ratchet device for a wrench in accordance with the present invention.
Figure 11:
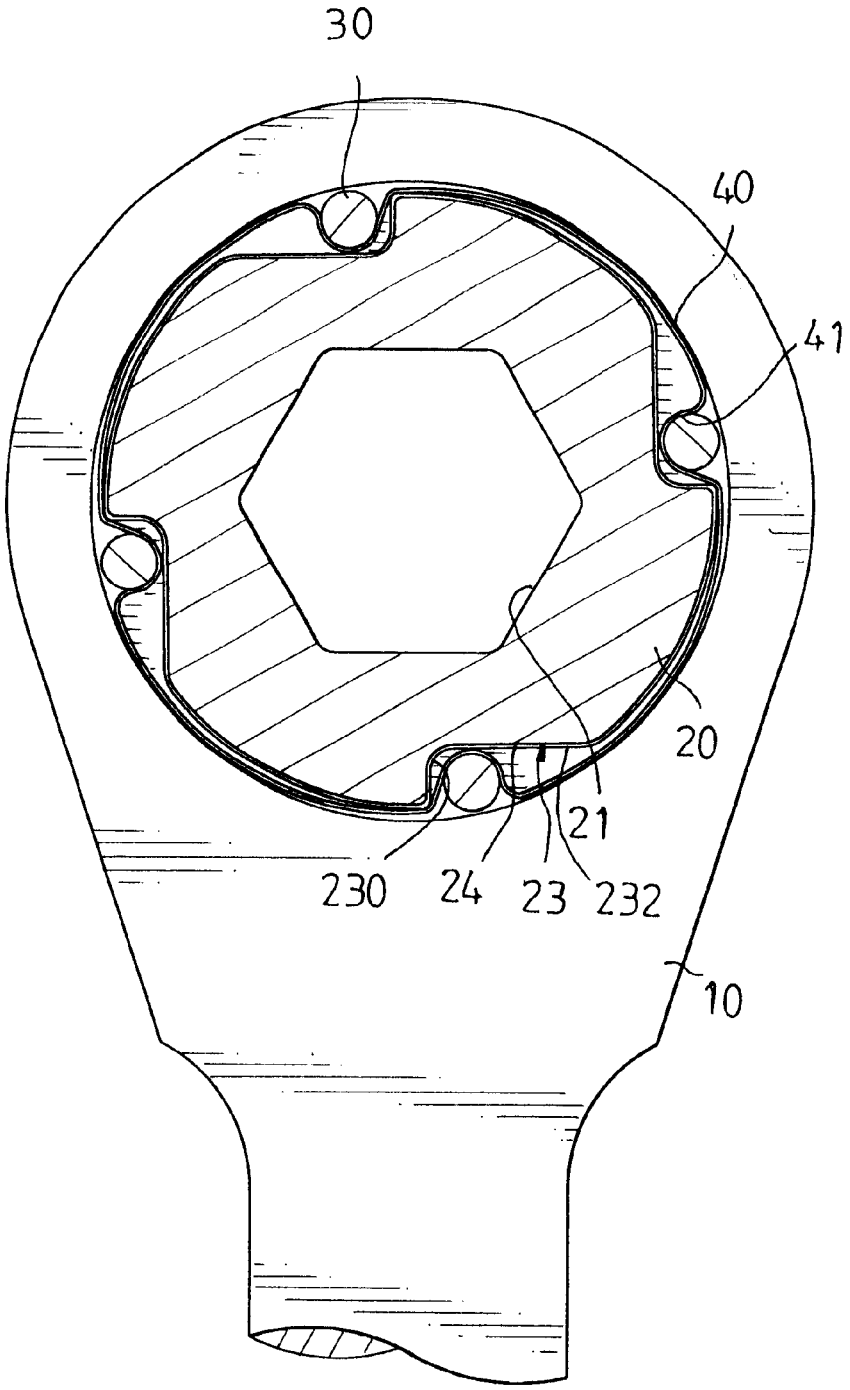
FIG. 11 is a top plan cross-sectional assembly view of the ratchet device as shown in FIG. 10.
Figure 12:
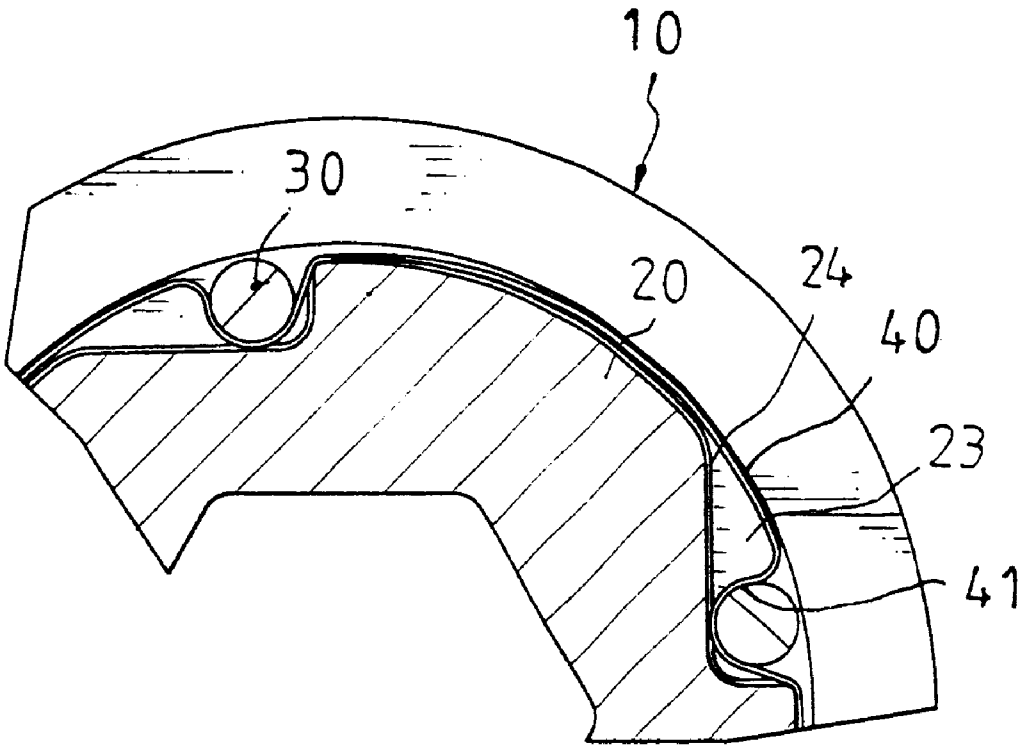
FIG. 12 is a partially enlarged view of the ratchet device as shown in FIG. 11.

Referring to FIGS. 10–12, a roller-type ratchet device in accordance with the present invention is used for a wrench which includes a driving head 10 having a receiving hole 11 defined therethrough.

The ratchet device comprises a driving body 20 secured in the receiving hole 11 to rotate with the driving head 10 and including an inner wall having a hexagonal driving hole 21 defined therethrough or having an actuating post 22 extending upward therefrom, and an outer wall defining a plurality of anti-reverse recesses 23 each including a deeper first portion 230 and a shallower second portion 232 having a depth smaller than that of the first portion 230, a ring-shaped flexible follower 40 located between the driving body 20 and the driving head 10 to rotate with the driving head 10 and including a plurality of C-shaped fixed portions 41 each extending radially inward and each mounted in a respective one of the anti-reverse recesses 23, and a plurality of rod-shaped anti-reverse rollers 30 each secured in a respective one of the fixed portions 41 of the follower 40 to move therewith, and each pressing the deeper first portion 230 of the respective anti-reverse recess 23 of the driving body 20.

The driving body 20 has a peripheral receiving groove 24 defined in the outer wall thereof for detachably receiving the C-shaped fixed portions 41 of the follower 40 therein.

Accordingly, the follower 40 together with the anti-reverse rollers 30 can be previously coupled together with each other to be fitted in the receiving hole 11 of the driving head 10, and the driving body 20 is then fitted in the receiving hole 11 of the driving head 10 so that the ratchet device can be easily assembled and dismantled, thereby decreasing the cost of fabrication and production. In addition, the follower 40 and the anti-reverse rollers 30 are coupled together with each other so that they are not spaced from each other when the ratchet wrench is dismantled. Moreover, the driving body 20 is driven by a plurality of anti-reverse rollers 30 which are simultaneously driven by the fixed portions 41 of the follower 40, thereby providing a large torque and a multiple anti-slid effect on the workpiece (not shown). Further, the follower 40 is made with flexibility and elasticity for providing elastic space to the anti-reverse rollers 30 so that they can be actually pressed and positioned between the driving head 10 and the driving body 20.

Figure 13:
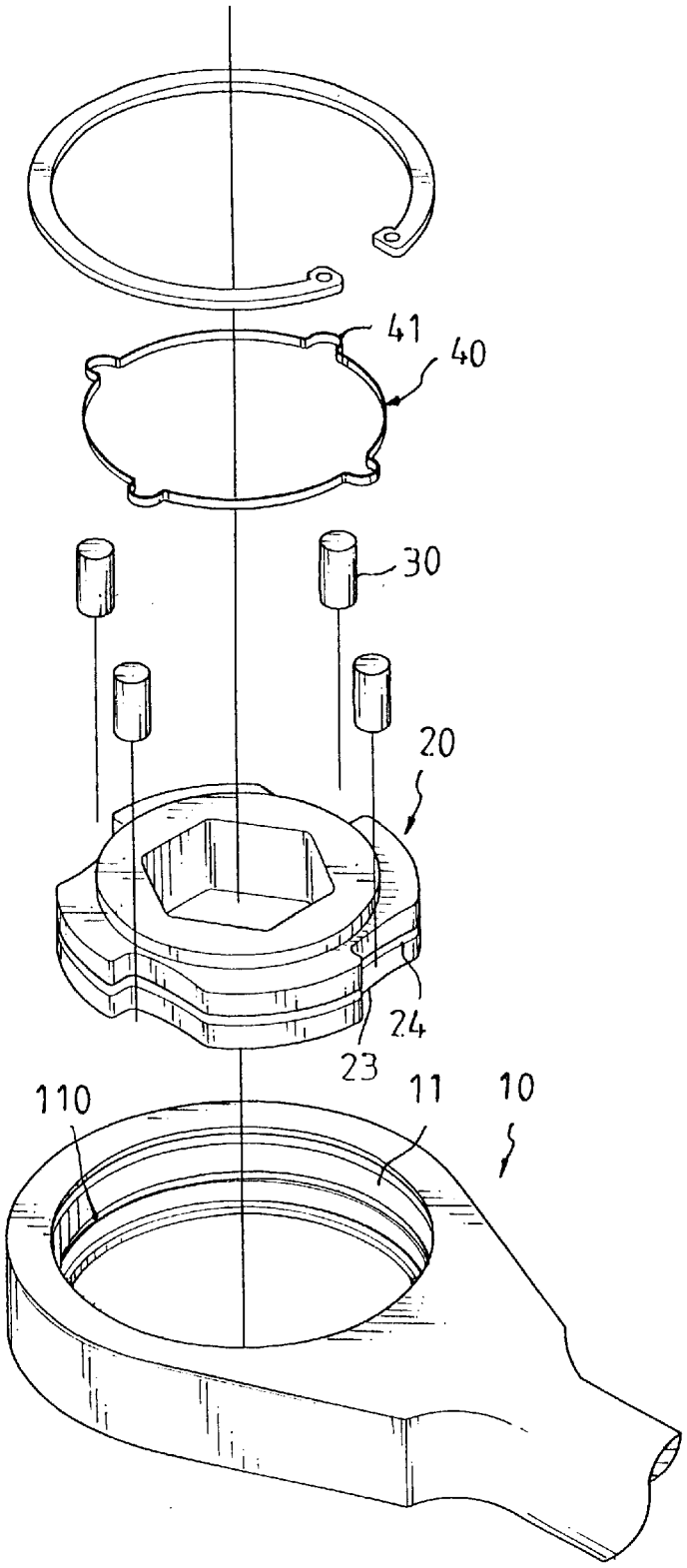
FIG. 13 is an exploded view of a roller-type ratchet device for a wrench in accordance with another embodiment of the present invention.

Referring to FIG. 13, in accordance with another embodiment of the present invention, the driving head 10 defines an annular receiving groove 110 connecting to the receiving hole 11, and the ring-shaped flexible follower 40 includes a plurality of C-shaped fixed portions 41 each extending radially outward therefrom and detachably received in the receiving groove 110.

Figure 14:
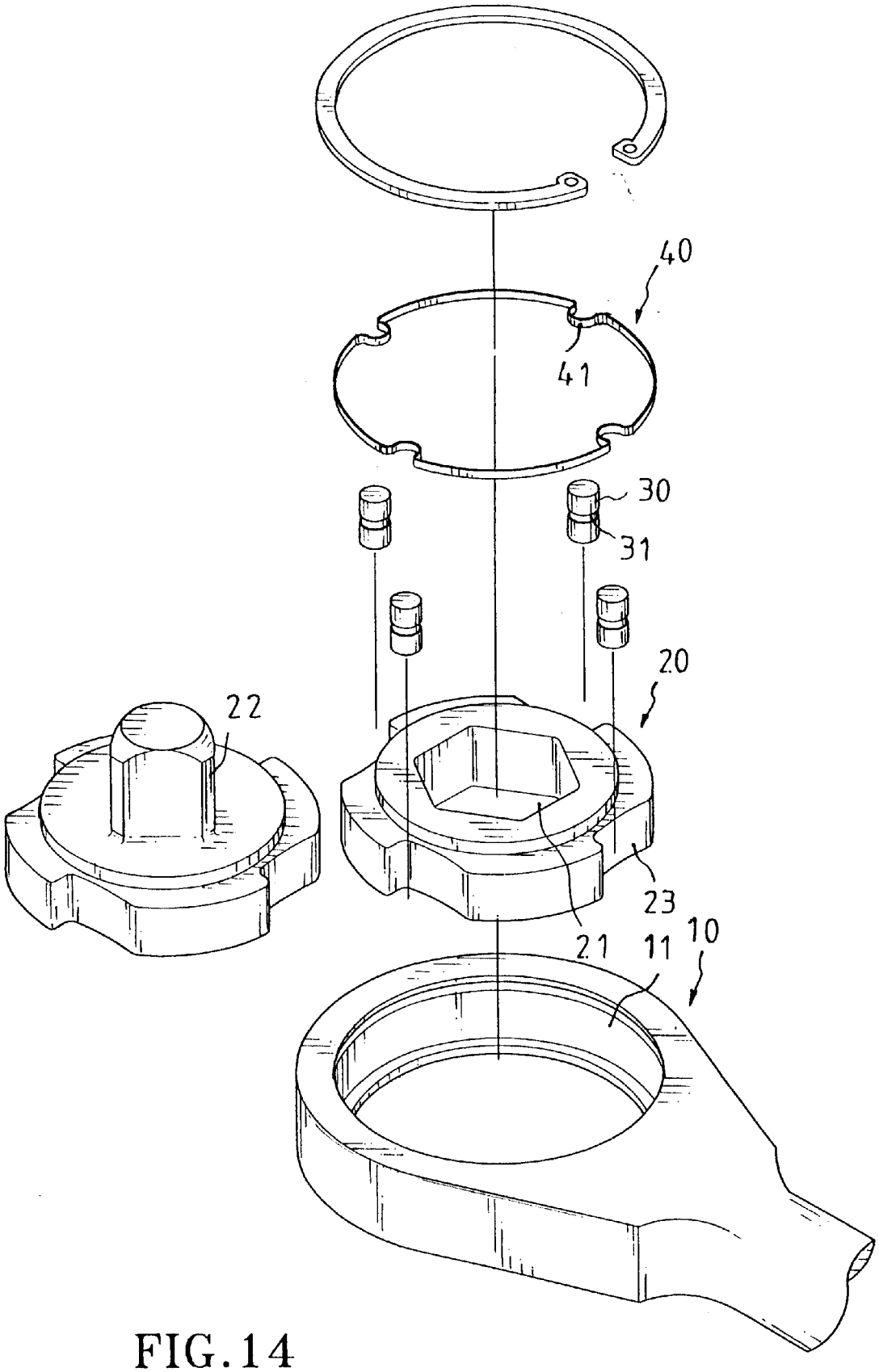
FIG. 14 is an exploded view of a roller-type ratchet device for a wrench in accordance with a further embodiment of the present invention.
Figure 15:
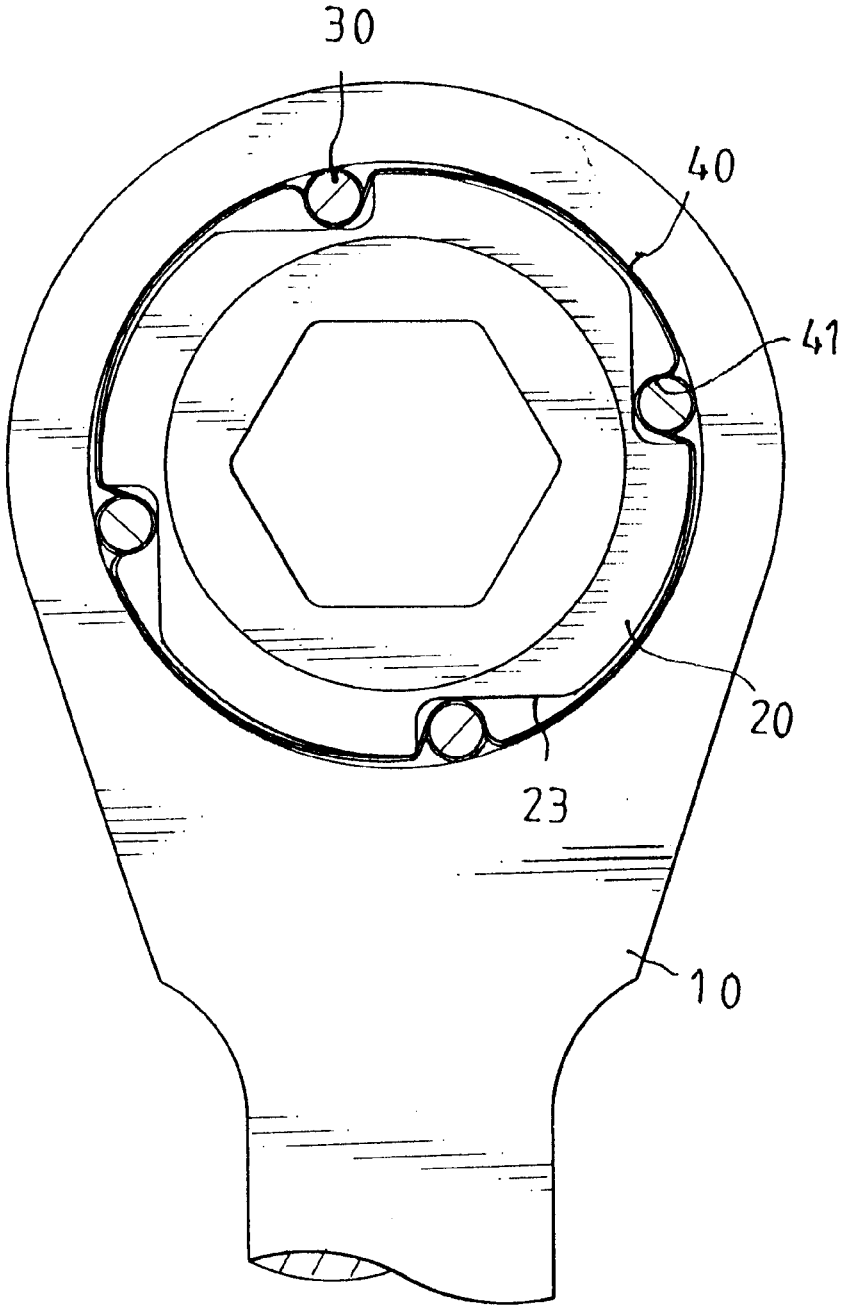
FIG. 15 is a top plan assembly view of the ratchet device as shown in FIG. 14.
Figure 16:
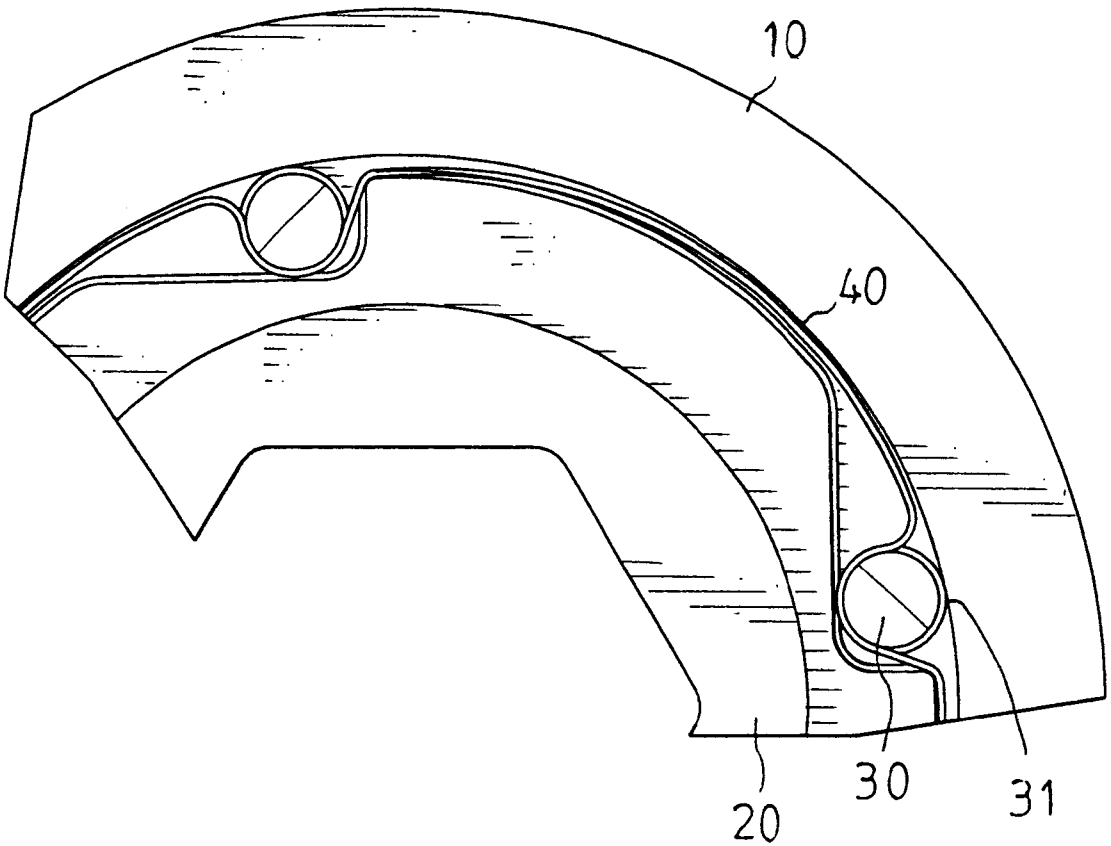
FIG. 16 is a partially enlarged view of the ratchet device as shown in FIG. 15.

Referring to FIGS. 14–16, in accordance with a further embodiment of the present invention, each of the anti-reverse rollers 30 defines an annular recessed positioning portion 31 for securing a respective one of the fixed portions 41 of the follower 40 therein.

Figure 17:
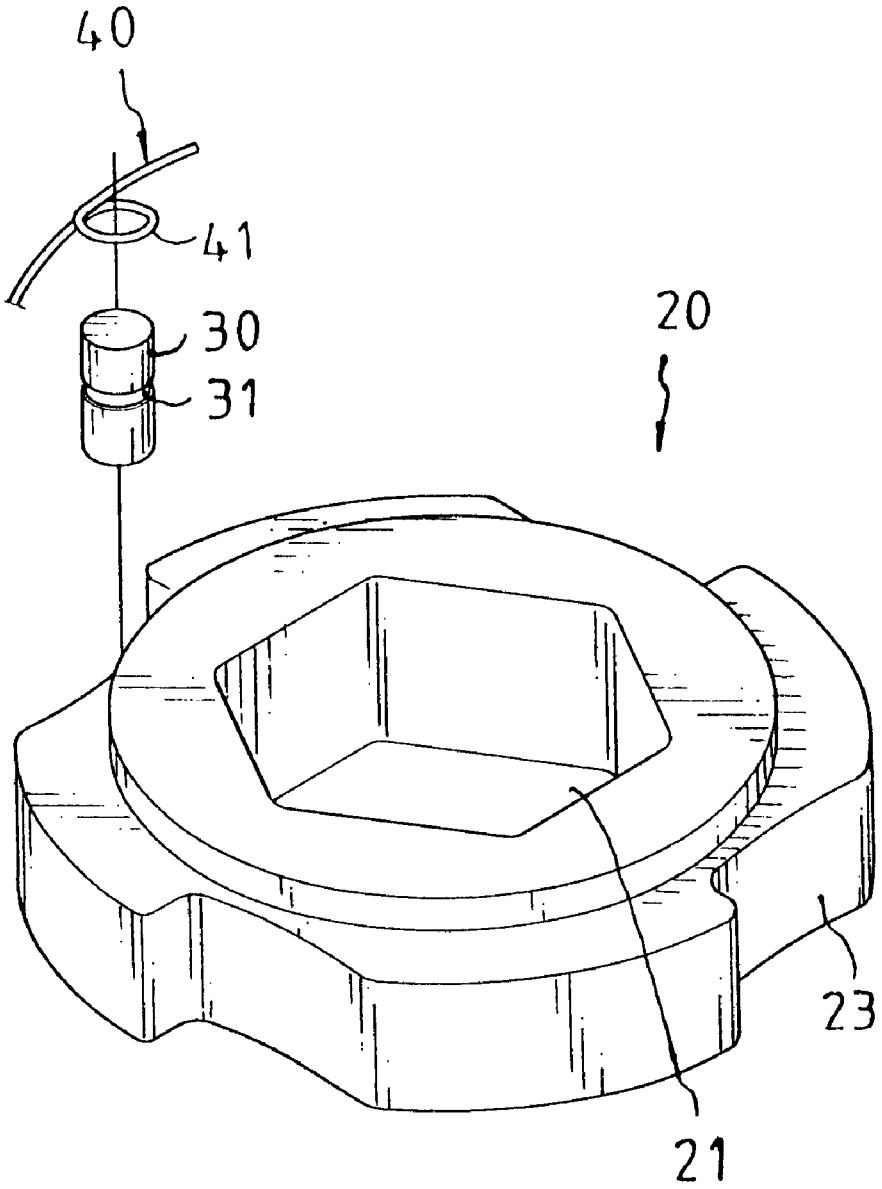
FIG. 17 is a partially exploded view of a roller-type ratchet device for a wrench in accordance with a further embodiment of the present invention.

Referring to FIG. 17, in accordance with a further embodiment of the present invention, each of the fixed portions 41 of the follower 40 is wound around the recessed positioning portion 31 of the respective anti-reverse roller 30.

Figure 18:
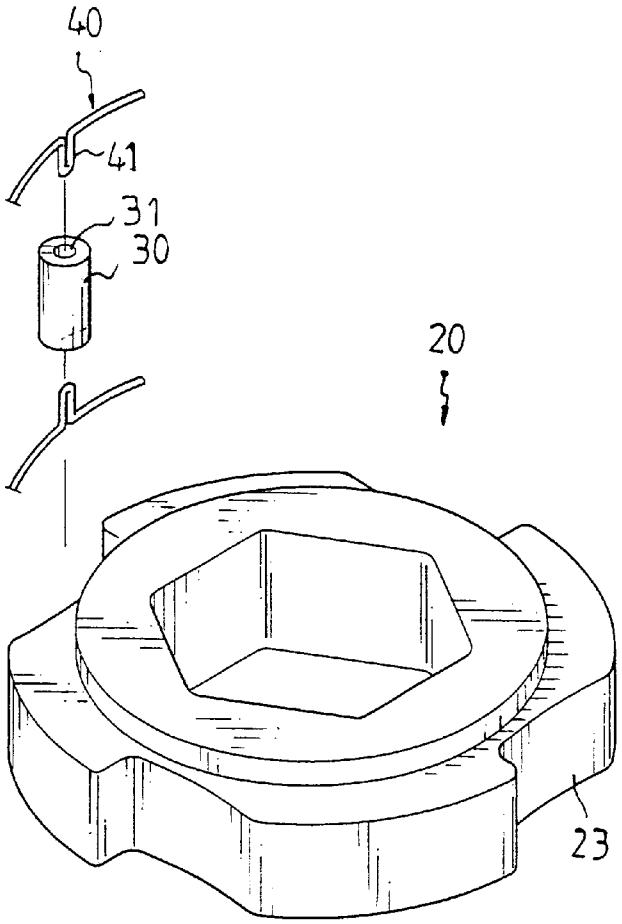
FIG. 18 is a partially exploded view of a roller-type ratchet device for a wrench in accordance with a further embodiment of the present invention.

Referring to FIG. 18, in accordance with a further embodiment of the present invention, each of the anti-reverse rollers 30 includes two distal ends each defining a recessed positioning portion 31. The ratchet device comprises two ring-shaped followers 40 each including a plurality of protruding fixed portions 41 each secured in the positioning portion 31 of a respective one of the anti-reverse rollers 30.

Figure 19:
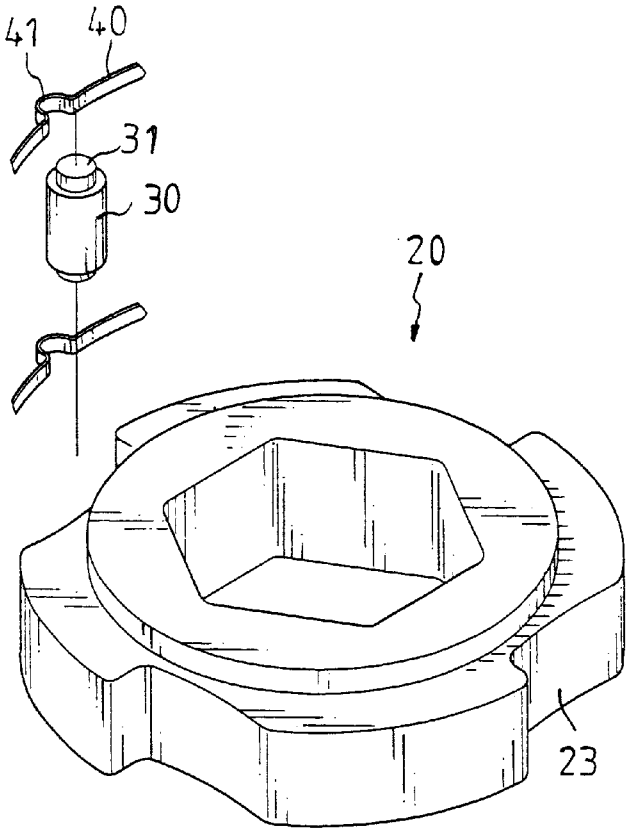
FIG. 19 is a partially exploded view of a roller-type ratchet device for a wrench in accordance with a further embodiment of the present invention.

Referring to FIG. 19, in accordance with a further embodiment of the present invention, each of the anti-reverse rollers 30 includes two distal ends each having a protruding positioning portion 31. The ratchet device comprises two ring-shaped followers 40 each including a plurality of C-shaped fixed portions 41 each mounted on the positioning portion 31 of a respective one of the anti-reverse rollers 30.

Figure 20:
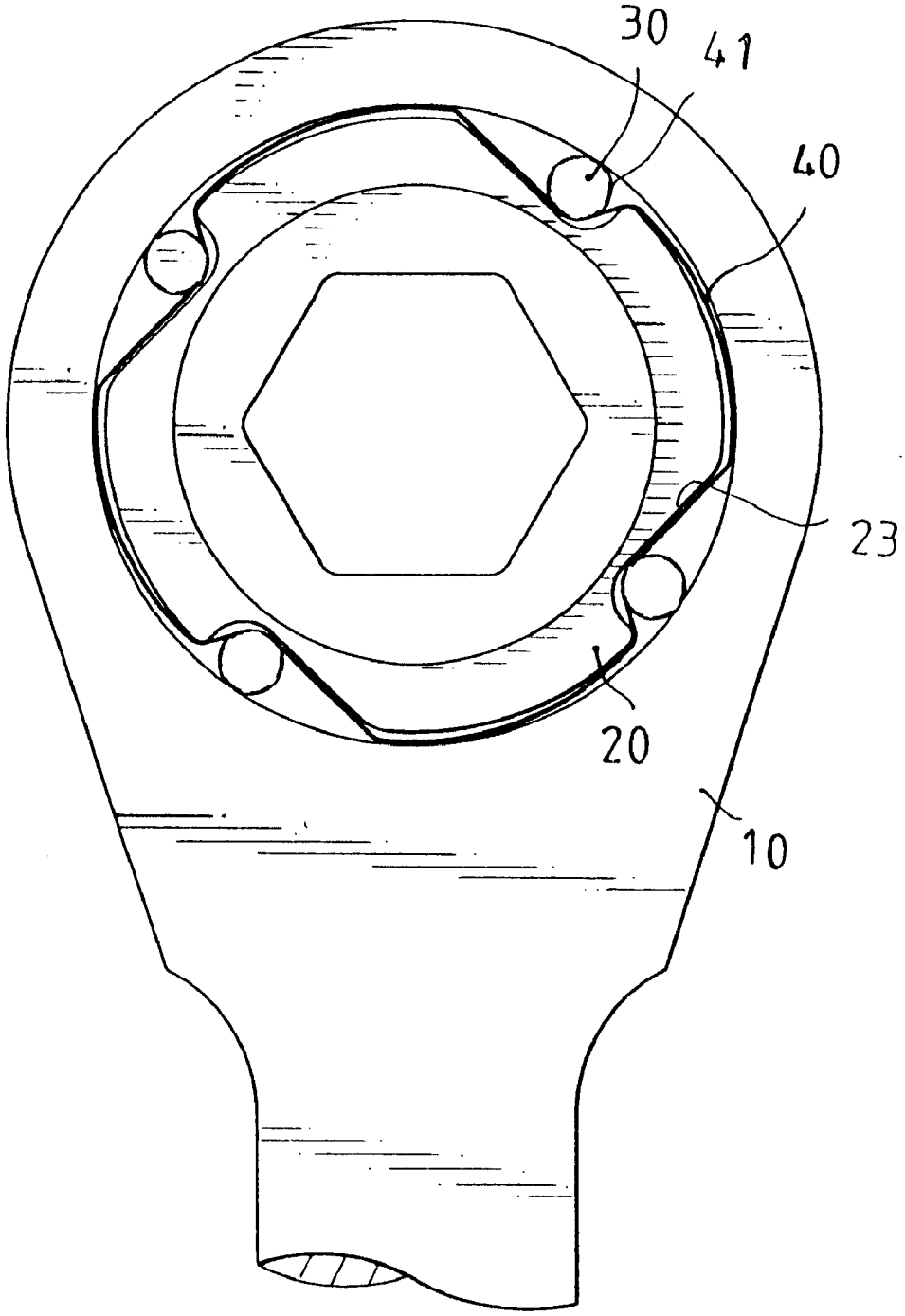
FIG. 20 is a top plan assembly view of a roller-type ratchet device for a wrench in accordance with a further embodiment of the present invention.
Figure 21:
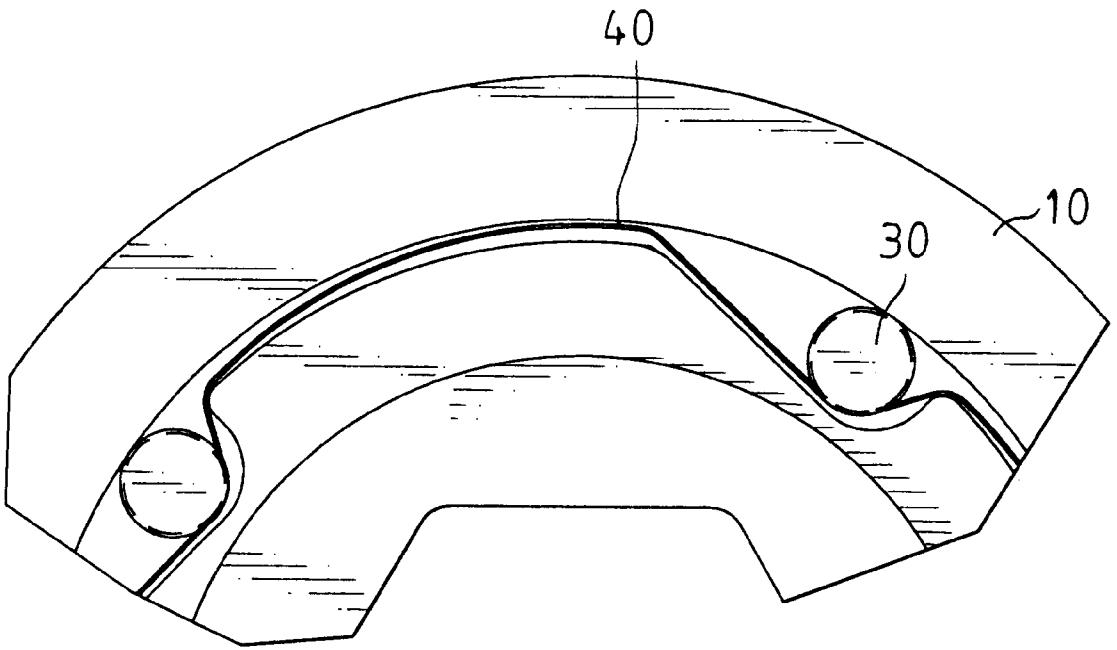
FIG. 21 is a partially enlarged view of the ratchet device as shown in FIG. 20.

Referring to FIGS. 20 and 21, according to a further embodiment of the present invention, the follower 40 includes a plurality of bent fixed portions 41 received in and mating the shape of the respective anti-reverse recess 23 of the driving body 20.

Figure 22:
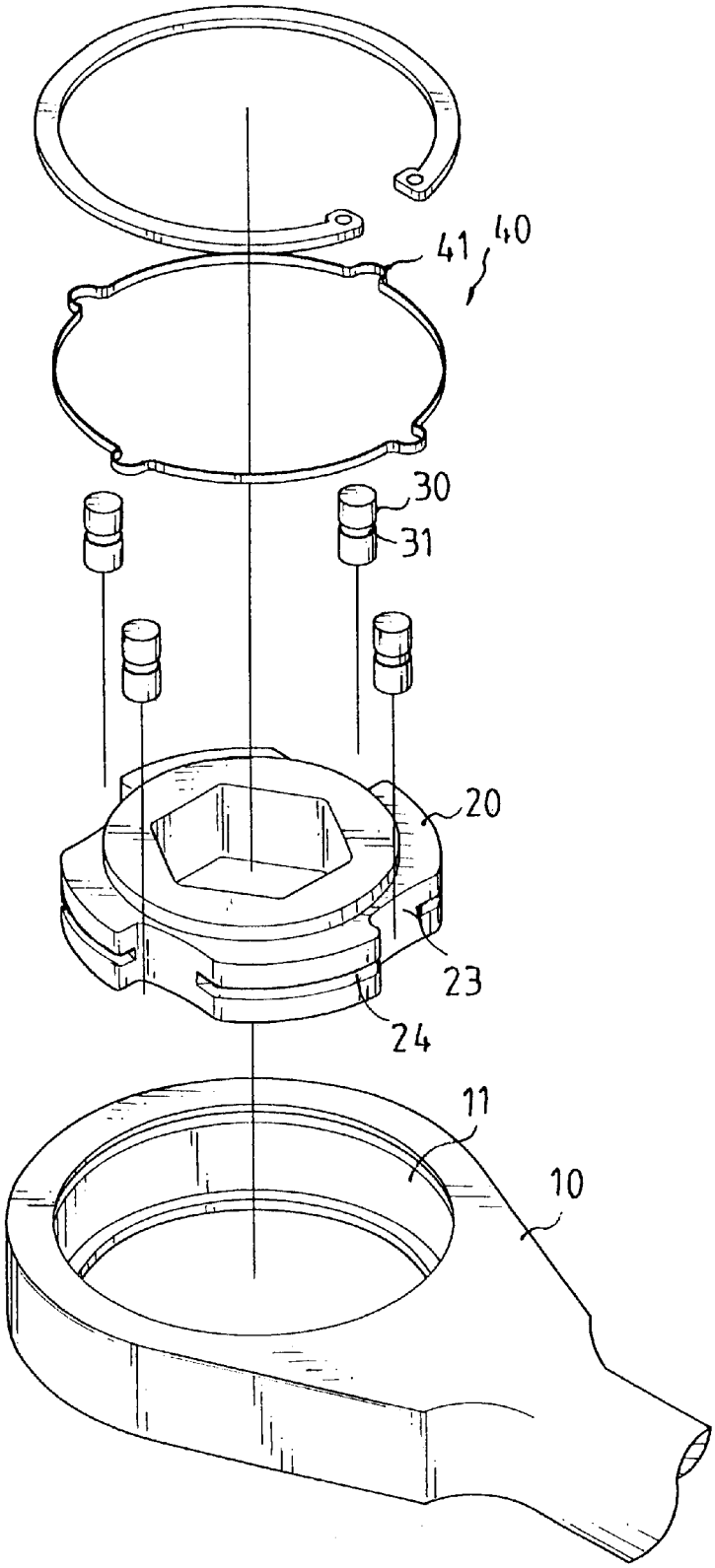
FIG. 22 is an exploded view of a roller-type ratchet device for a wrench in accordance with a further embodiment of the present invention.

Referring to FIG. 22, in accordance with a further embodiment of the present invention, the driving body 20 has a peripheral receiving groove 24 defined in the outer wall thereof for detachably receiving the follower 40.

Figure 23:
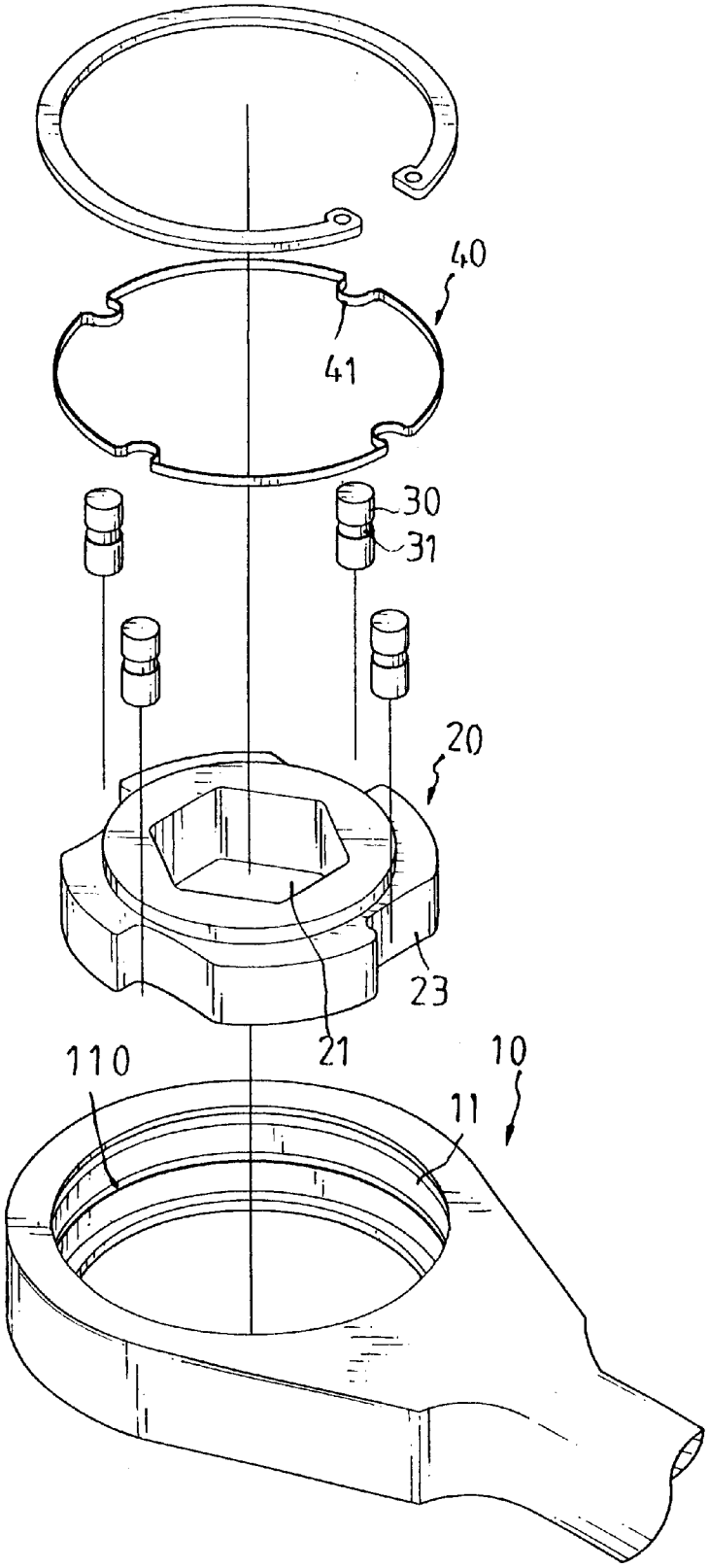
FIG. 23 is an exploded view of a roller-type ratchet device for a wrench in accordance with a further embodiment of the present invention.

Referring to FIG. 23, in accordance with a further embodiment of the present invention, the driving head 10 defines an annular receiving groove 110 for detachably receiving the follower 40.

Figure 24:
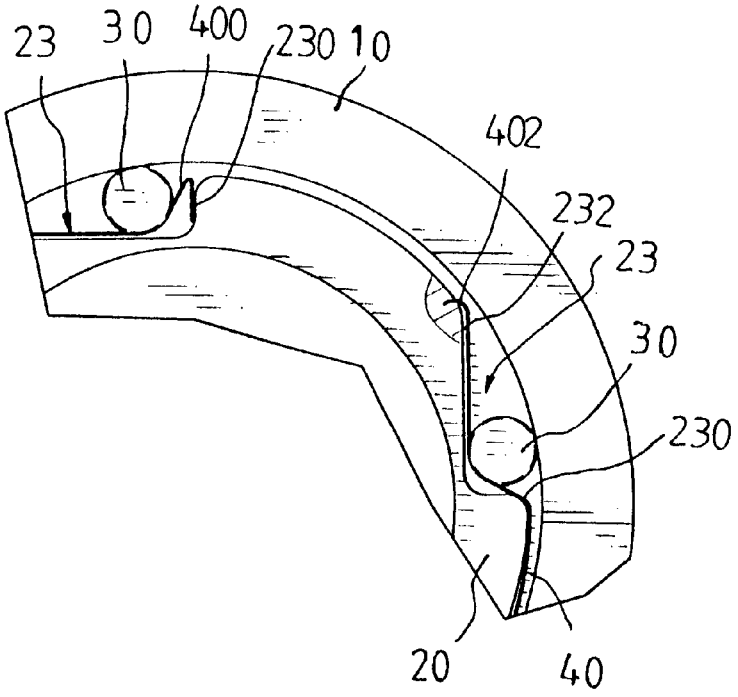
FIG. 24 is a partially top plan assembly view of a roller-type ratchet device for a wrench in accordance with a further embodiment of the present invention.

Referring to FIG. 24, in accordance with a further embodiment of the present invention, the follower 40 is cut out to form an elastic first end 400 received in the deeper first portion 230 of one of the anti-reverse recesses 23 and pressing the respective anti-reverse roller 30, and a second end 402 secured to the shallower second portion 232 of an adjacent anti-reverse recess 23.

Figure 25:
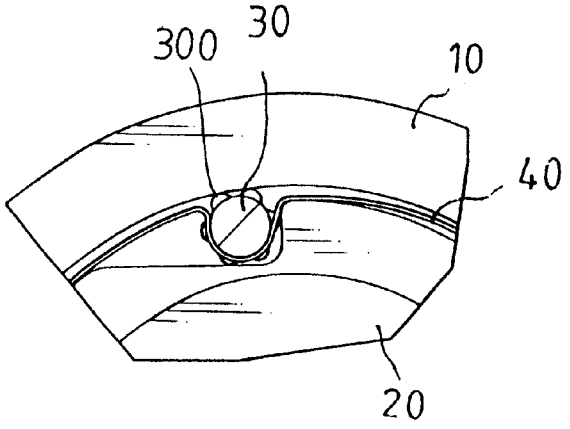
FIG. 25 is a partially top plan assembly view of a roller-type ratchet device for a wrench in accordance with a further embodiment of the present invention.

Referring to FIG. 25, in accordance with a further embodiment of the present invention, each of the anti-reverse rollers 30 includes a plurality of arcuate protrusions 300 formed on an outer periphery thereof.

Figure 26:
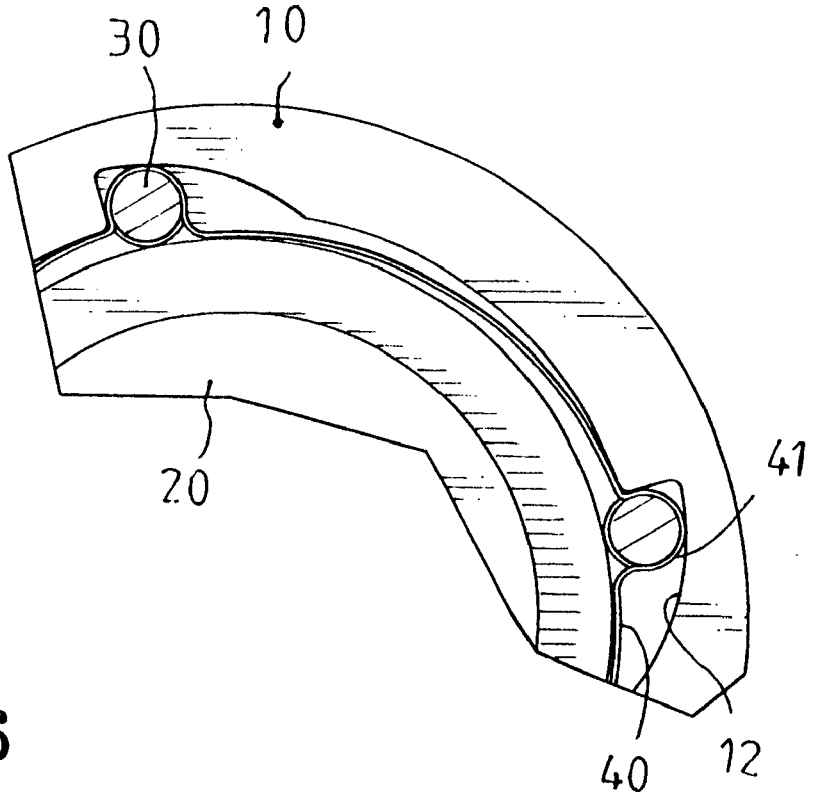
FIG. 26 is a partially top plan assembly view of a roller-type ratchet device for a wrench in accordance with a further embodiment of the present invention.
Figure 27:
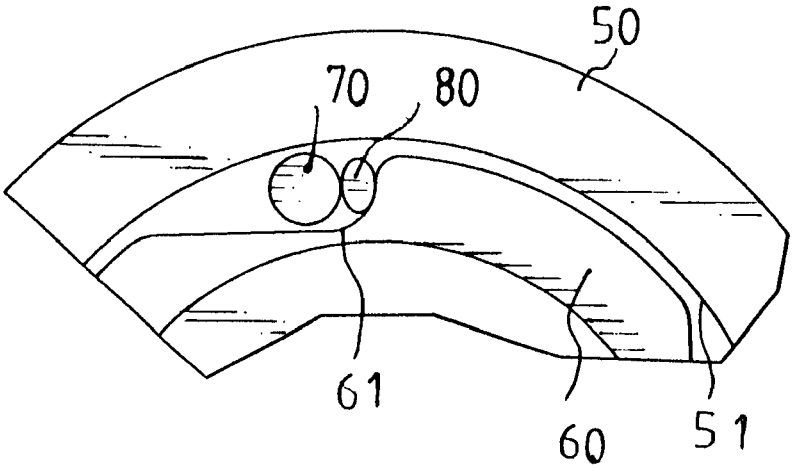
FIG. 27 is a partially top plan assembly view of a conventional ratchet wrench in accordance with the prior art.

Referring to FIG. 26, in accordance with a further embodiment of the present invention, the anti-reverse recesses 23 of the driving body 20 are undefined, and the driving head 10 defines a plurality of actuating recesses 12 for receiving the fixed portions 41 of the follower 40 together with the anti-reverse rollers 30 therein.

It should be clear to those skilled in the art that further embodiments may be made without departing from the scope of the present invention.

What is claimed is:

1. A roller-type ratchet device for a wrench, said wrench including a driving head (10), a receiving hole (11) defined through said driving head (10), and a plurality of actuating recesses (12) each defined in a wall of said receiving hole (11), said ratchet device comprising:

a driving body (20) secured in said receiving hole (11) to rotate with said driving head (10) and defining a hexagonal driving hole (21 ) therein;

a follower (40) secured in said receiving hole (11) to rotate with said driving head (10) and located between said driving body (20) and said driving head (10), said follower (40) including a plurality of fixed portions (41) each movably mounted in a respective one of said actuating recesses (12);

a plurality of locking members (50) each secured in a respective one of said fixed portions (41) of said follower (40) to move therewith, and each pressing said driving body (20); and a direction control knob (30) pivotally mounted on said driving head (10) and engaged with said follower (40) for moving each of said locking members (50) in said respective actuating recess (12) between different positions.

2. The ratchet device in accordance with claim 1, wherein said driving head (10) includes an inner wall defining a receiving chamber (13) connecting to said receiving hole (11), and a pivot hole (14) defined through said driving head (10) and connecting to said receiving chamber (13), said follower (40) further includes a driven portion (42) movably received in said receiving chamber (13), and said direction control knob (30) includes a pivot base (33) pivotally mounted in said pivot hole (14) and having an upper portion and a lower portion defining a peripheral retaining groove (330), a snapping member (34) mounted in said retaining groove (330) and abutting said driving head (10), a supporting base (32) secured on said pivot base (33) to pivot therewith and abutting said driving head (10), a control portion (31) secured to said supporting base (32) for pivoting said pivot base (32) about said pivot base (33), and a driving rod (35) secured to said supporting base (32) to pivot therewith and engaged with said driven portion (42) of said follower (40) for moving said driven portion (42) of said follower (40).

3. The ratchet device in accordance with claim 2, wherein said driving head (10) defines a transverse receiving space (15) connecting to said pivot hole (14), said direction control knob (30) further includes a pawl member (331) mounted on said pivot base (33) and located opposite to said driving rod (35), and said ratchet device further comprises a ball (17) received in said receiving space (15) and detachably pressing said pawl member (331), and a biasing member (16) received in said receiving space (15) and urged between said ball (17) and a wall of said receiving space (15).

4. The ratchet device in accordance with claim 1, wherein said follower (40) is a ring-shaped flexible piece including a plurality of C-shaped fixed portions (41) extending radially outward for securing said respective locking members (50) therein.

5. The ratchet device in accordance with claim 4, wherein each of said locking members (50) is a rod-shaped roller.

6. The ratchet device in accordance with claim 5, wherein each of said locking members (50) defines an annular retaining depression (51) for securing a respective one of said fixed portions (41) of said follower (40) therein.

7. The ratchet device in accordance with claim 1, wherein said driving body (20) includes a plurality of arcuate first teeth (200) formed on an outer periphery thereof, and each of said locking members (50) includes a plurality of arcuate second teeth (500) formed on an outer periphery thereof and engaged with said first teeth (200) of said driving body (20).

8. A roller-type ratchet device for a wrench, said wrench including a driving head (10) having a receiving hole (11) defined therethrough, said ratchet device comprising:

a driving body (20) secured in said receiving hole (11) to rotate with said driving head (10) and including an inner wall having a hexagonal driving hole (21) defined therethrough, and an outer wall defining a plurality of anti-reverse recesses (23), each of said anti-reverse recesses (23) including a first portion (230) and a second portion (232) having a depth smaller than that of said first portion (230);

a follower (40) secured in said receiving hole (11) to rotate with said driving head (10) and located between said driving body (20) and said driving head (10), said follower (40) including a plurality of fixed portions (41) each mounted in a respective one of said anti-reverse recesses (23); and a plurality of anti-reverse rollers (30) each secured in a respective one of said fixed portions (41) of said follower (40) to move therewith, and each pressing said first portion (230) of said respective anti-reverse recess (23) of said driving body (20).

9. The ratchet device in accordance with claim 8, wherein said driving body (20) has a peripheral receiving groove (24) defined in the outer wall thereof, and said follower (40) is a ring-shaped flexible piece including a plurality of C-shaped fixed portions (41) extending radially inward therefrom and detachably received in said receiving groove (24).

10. The ratchet device in accordance with claim 8, wherein said driving head (10) defines an annular receiving groove (110) connecting to said receiving hole (11), and said follower (40) is a ring-shaped flexible piece including a plurality of C-shaped fixed portions (41) each extending radially outward therefrom and detachably received in said receiving groove (110).

11. The ratchet device in accordance with claim 8, wherein each of said anti-reverse rollers (30) defines an annular recessed positioning portion (31) for securing a respective one of said fixed portions (41) of said follower (40) therein.

12. The ratchet device in accordance with claim 11, wherein each of said fixed portions (41) of said follower (40) has a ring shape and is wound around said positioning portion (31) of said respective anti-reverse roller (30).

13. The ratchet device in accordance with claim 8, wherein each of said anti-reverse rollers (30) includes two distal ends each defining a recessed positioning portion (31), and said ratchet device comprises two ring-shaped followers (40) each including a plurality of protruding fixed portions (41) each secured in said positioning portion (31) of a respective one of said anti-reverse rollers (30).

14. The ratchet device in accordance with claim 8, wherein each of said anti-reverse rollers (30) includes two distal ends each having a protruding positioning portion (31), and said ratchet device comprises two ring-shaped followers (40) each including a plurality of C-shaped fixed portions (41) each mounted on said positioning portion (31) of a respective one of said anti-reverse rollers (30).

15. The ratchet device in accordance with claim 8, wherein said follower (40) includes an elastic first end (400) received in said first portion (230) of one of said anti-reverse recesses (23) and pressing said respective anti-reverse roller (30), and a second end (402) secured to said second portion (232) of an adjacent anti-reverse recess (23).

16. The ratchet device in accordance with claim 8, wherein each of said anti-reverse rollers (30) includes a plurality of arcuate protrusions (300) formed on an outer periphery thereof.

* * * * *